US008056766B2

(12) United States Patent
Grevin

(10) Patent No.: US 8,056,766 B2
(45) Date of Patent: Nov. 15, 2011

(54) ASSEMBLY FOR CONTAINING AND DISPENSING A LIQUID

(75) Inventor: Guillaume Grevin, Gruchet Saint Simeon (FR)

(73) Assignee: Rexam Pharma, Offranville (FR)

( * ) Notice: Subject to any disclaimer, the term of this patent is extended or adjusted under 35 U.S.C. 154(b) by 612 days.

(21) Appl. No.: 12/280,354

(22) PCT Filed: Feb. 22, 2007

(86) PCT No.: PCT/FR2007/000320

§ 371 (c)(1),
(2), (4) Date: Sep. 29, 2008

(87) PCT Pub. No.: WO2007/096526

PCT Pub. Date: Aug. 30, 2007

(65) Prior Publication Data

US 2009/0152302 A1 Jun. 18, 2009

(30) Foreign Application Priority Data

Feb. 23, 2006 (FR) ..... 06 01607

(51) Int. Cl.
*B67D 7/76* (2010.01)

(52) U.S. Cl. ..... 222/189.06; 222/107; 222/189.09; 222/213; 222/562

(58) Field of Classification Search ..... 222/189.06, 222/92, 95, 107, 213–215, 420–422, 481.5, 222/542, 562, 189.09
See application file for complete search history.

(56) References Cited

U.S. PATENT DOCUMENTS

| | | | | |
|---|---|---|---|---|
| 4,917,271 | A * | 4/1990 | Kanner et al. | 222/189.09 |
| 4,938,389 | A * | 7/1990 | Rossi et al. | 222/189.08 |
| 5,105,993 | A * | 4/1992 | La Haye et al. | 222/189.09 |
| 5,154,325 | A * | 10/1992 | Ryder et al. | 222/189.06 |
| 5,249,712 | A * | 10/1993 | Lontrade et al. | 222/189.08 |
| 5,265,770 | A * | 11/1993 | Matkovich et al. | 222/189.06 |
| 5,499,751 | A | 3/1996 | Meyer | |
| 5,588,559 | A * | 12/1996 | Vallet Mas et al. | 222/92 |
| 5,611,464 | A * | 3/1997 | Tsao et al. | 222/189.06 |
| 5,992,701 | A * | 11/1999 | Bougamont et al. | 222/189.06 |
| 6,076,709 | A * | 6/2000 | Wilner | 222/212 |
| 6,336,571 | B1 * | 1/2002 | Chibret et al. | 222/189.09 |
| 6,672,479 | B2 | 1/2004 | Shiraishi et al. | |
| 6,708,850 | B2 * | 3/2004 | Uetake et al. | 222/189.06 |
| 7,225,949 | B2 * | 6/2007 | Kubo et al. | 222/189.08 |
| 7,303,098 | B2 * | 12/2007 | Backes | 222/212 |
| 2008/0067194 | A1 | 3/2008 | Faurie | |

FOREIGN PATENT DOCUMENTS

| | | | |
|---|---|---|---|
| FR | 2 872 137 | A | 12/2005 |
| JP | 2002-263166 | A | 9/2002 |
| WO | 93/13737 | A | 7/1993 |

* cited by examiner

*Primary Examiner* — Frederick C. Nicolas
(74) *Attorney, Agent, or Firm* — Young & Thompson

(57) ABSTRACT

This assembly is of the type including: a container (4) for containing the liquid; a liquid dispensing device (6), including: a spout (20) through which liquid can pass out and air can come in; and elements (28) for filtering liquid and air passing through the spout (20); and a cap (14) for closing the container (4). One feature of the invention is that the assembly includes elements (38, 41, 39) for encouraging the entrance of air and/or the return of a residual quantity of liquid trapped in the spout (20) after dispensing some liquid, through the filtering elements (28), into the container (4).

18 Claims, 4 Drawing Sheets

ASSEMBLY FOR CONTAINING AND DISPENSING A LIQUID

The present invention relates to an assembly for containing and dispensing a liquid, comprising:

a container for containing the liquid;

a liquid dispensing device arranged at the outlet of the container, comprising:

a spout through which liquid can pass out and air can come in; and means for filtering liquid and air passing through the spout; and a cap for closing the container.

The invention applies in particular, but not exclusively, to assemblies for containing and dispensing collyrium in the form of an aqueous solution, the sterility of which must be ensured.

The filtering means prevent the penetration of contaminating agents into the container before the membrane.

An object of the invention is to provide an assembly for containing and dispensing a liquid limiting the risk of dispensing contaminated liquid.

For this purpose, the invention proposes an assembly for containing and dispensing a liquid of the above-mentioned type, characterised in that it comprises means for encouraging the entry of air and/or the return of a residual quantity of liquid trapped in the spout after dispensing some liquid, through the filtering means, into the container.

According to other embodiments, the containing assembly has one or more of the following features, taken in isolation or according to all of the combinations technically possible:

the means for increasing the entry of air and/or the return of a residual quantity of liquid comprise sealing means capable of closing in a sealed manner a space located between the spout and the partially-closed cap, the volume of which decreases as closure of the cap progresses, so as to create an overpressure in the spout downstream of the filtering means, due to the cap being closed;

the sealing means comprise a sealing lip which is integral with the spout and comes into sealed contact with an internal sealing bearing surface of the cap as the cap is closed;

the lip is integral with a part of the tubular spout having a longitudinal axis;

the lip protrudes beyond the part, said lip being inclined in relation to the longitudinal axis, radially outwards and axially towards a bottom of the cap;

the cap comprises a bottom coming into sealed contact with an outlet orifice of the spout when the cap is completely closed;

the filtering means comprise at least one microporous filtering membrane extending through a passage for the circulation of liquid and air through the spout;

the microporous filtering membrane comprises at least one liquophilic region and at least one liquophobic region;

the membrane is secured between two mutually-fixed parts of the spout;

the means for increasing the entry of air and/or the return of a residual quantity of liquid comprise a layer of porous liquophobic material, capable of being passed through by a liquid, in contact with an upstream face of the membrane; and the means of filtration comprise one microporous filtering membrane.

BRIEF DESCRIPTION OF THE DRAWINGS

Further features and advantages of the invention will emerge from the following description, given purely by way of example, with reference to the accompanying drawings, in which.

DETAILED DESCRIPTION OF THE INVENTION

Figure 1:
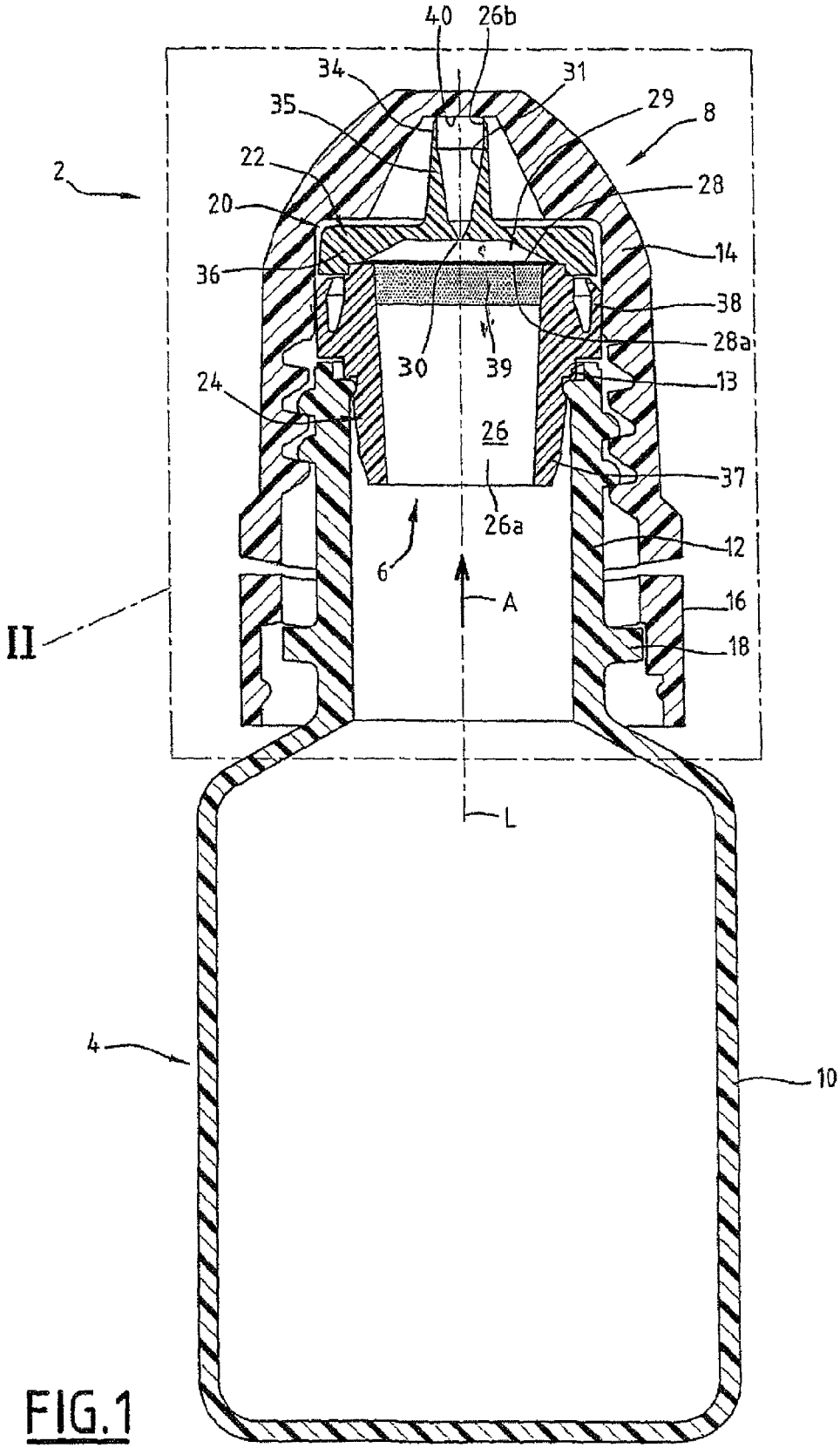
FIG. 1 is a schematic cross-section of a containing and dispensing assembly according to the invention.

The containing and dispensing assembly 2 shown in FIG. 1 comprises a container 4 for holding collyrium in the form of an aqueous solution, a device 6 for dispensing collyrium and a device 8 for closing the container 4.

The container 4 in the embodiment illustrated is a bottle made of a plastics material, containing collyrium which has not been shown in the Figures.

The container 4 comprises a hollow body 10 lengthened by an upper neck 12 which extends along a vertical longitudinal axis L to an outlet orifice 13.

In a conventional manner, the walls of the body 10 are resiliently deformable under the action of a transverse force so as to cause a reduction in the internal volume of the body 10, and thus enable the expulsion of the collyrium through the neck 12.

The closing device 8 comprises a cap 14 and an integral tamper-proof ring 16.

Conventionally, the neck 12 has external contours such as threads, enabling connection to the cap 14, which has complementary tapping, and the tamper-proof ring 16 is connected in translation along the axis L to a contour in the neck 12, for example a rib 18.

The dispensing device 6 comprises a spout 20 through which liquid can pass out and air can come in, accommodated partly in the neck 12 through the orifice 13.

In the rest of the description, the words <<upstream>> and <<downstream>> shall be understood to relate to the direction of flow of the collyrium through the neck 12 and the spout 20 from inside the body 10 towards the outside, as illustrated by an arrow A in FIG. 1.

The spout 20 comprises two parts 22 and 24 superimposed along the axis L and defining a passage 26 for the circulation of collyrium and air, the passage passing through the spout 20 along axis L from an orifice 26*a* opening into the body 10 to an orifice 26*b* opening to the outside.

The lower part 24 is connected in a sealed manner to the orifice 13.

The device 6 comprises a microporous membrane 28 to filter liquid and air extending across the passage 26.

The membrane 28 is mounted in the spout 20 being secured between the part 22 and the part 24. In a known manner, the membrane 28 has liquophilic regions and liquophobic regions.

The part 22 is arranged so as to prevent the formation of a jet of liquid so as to enable drop-by-drop dispensing of the collyrium. For this purpose, the portion 29 of the passage 26, located downstream of the membrane 28 and defined in the part 22, has a restriction 30, from upstream to downstream, followed by a diffuser 31 flaring out to the orifice 26*b* located at one free end 34 of a nipple 35 of the part 22 extending so as to protrude along the axis L from a base 36 in the form of a disc of the part 22, connected to the part 24.

The part 24 comprises a tubular sleeve 37 inserted partially in a sealed manner into the neck 12, and a circumferentially continuous annular resilient lip 38 integral with the sleeve 37, and extending so as to protrude radially outwards from the sleeve 37, outside the neck 12.

The device 6 comprises a block 39 of porous material with open cells, for example a compressible foam, allowing the passage of liquid and possessing liquophobic properties, in contact with an upstream face 28*a* of the membrane 28. The block 39 extends across the entire section of the passage 26.

Figure 2:
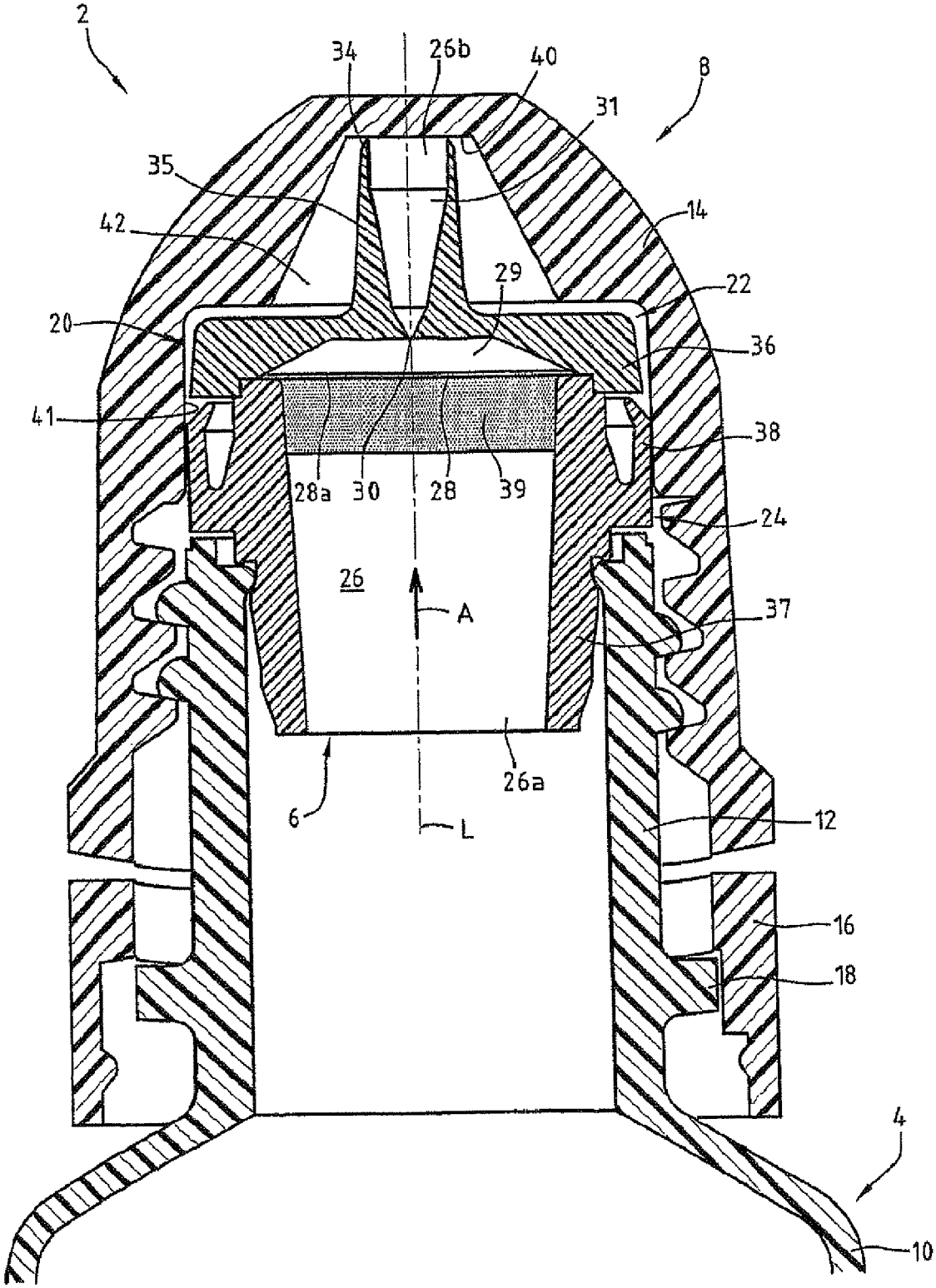
FIGS. 2 to 4 are partial enlarged views of the containing and dispensing assembly shown in FIG. 1.
Figure 3:
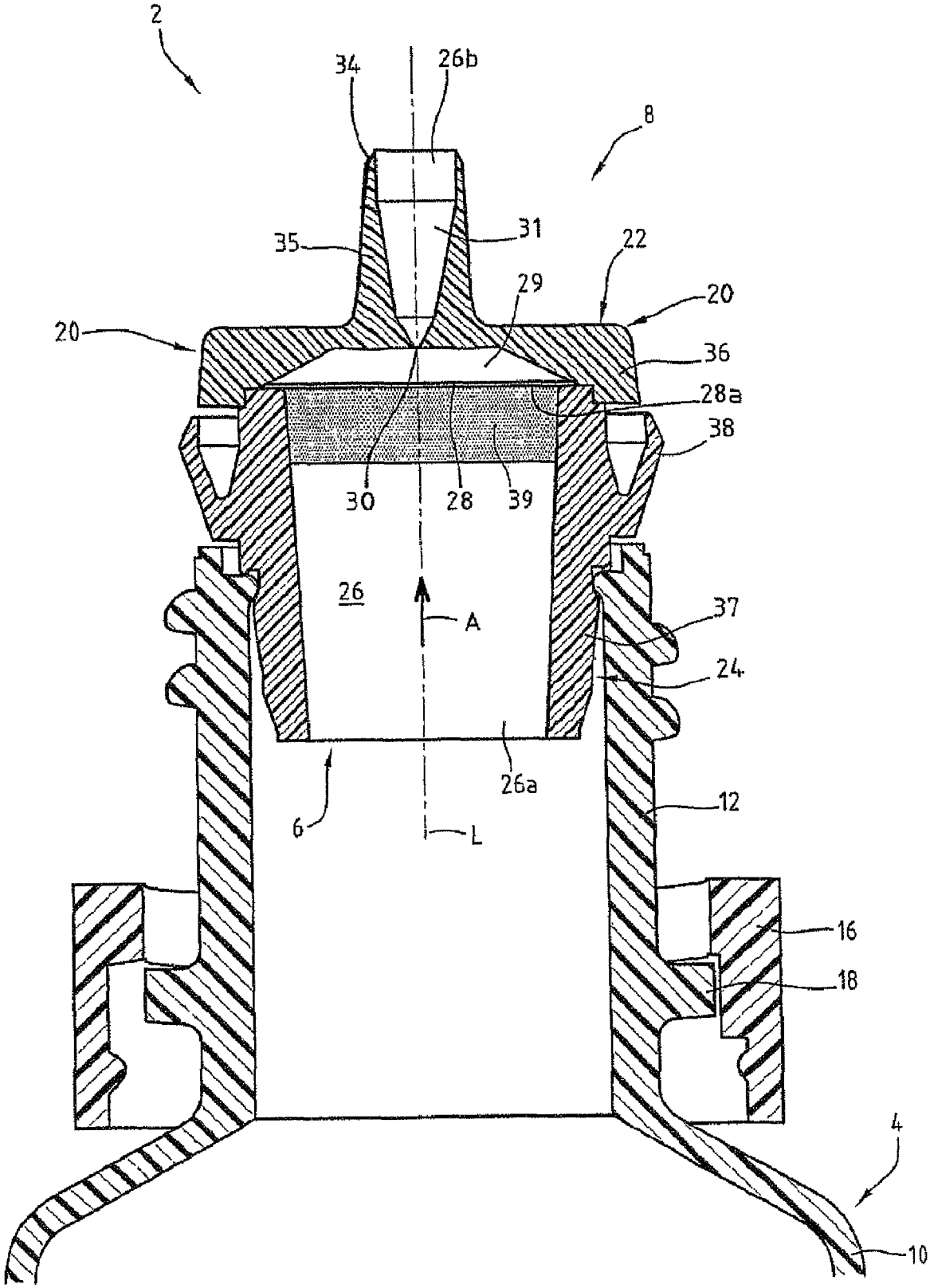
Figure 4:
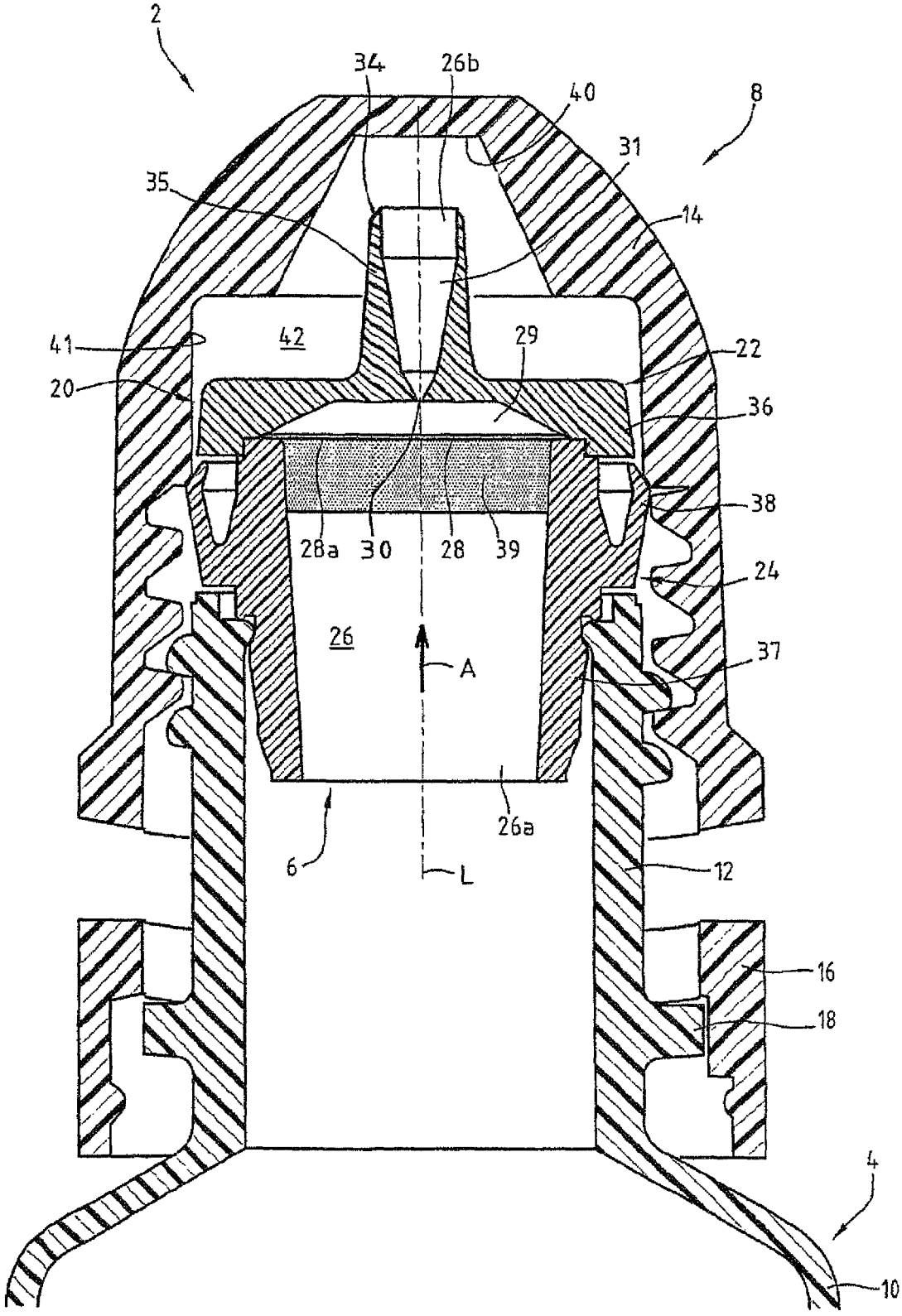

The operation of the assembly 2 is described below with reference to FIGS. 2 to 4 illustrating the assembly 2 in different configurations.

As shown in FIG. 2, the cap 14 is screwed onto the neck 12 so as to close the container 4. To open the container 4, the user unscrews the cap 14.

On first use, the user unscrews the cap 14 which breaks the connection between the cap 14 and the ring 16 since the latter is retained by the rib 18. This break indicates to the user that the flask has not been previously used. On subsequent use, the connection between the cap 14 and the ring 16 is already broken, and the cap 14 is unscrewed more easily.

Once the cap 14 is removed (FIG. 3), the user turns the container 4 upside-down, and presses the walls of the body 10 so as to expel the collyrium through the neck 12 and the device 6 by forcing its passage through the block 39 and the membrane 28.

Once dispensing has been completed, the user releases the walls of the body 10, which are brought back to their original shape by resilience. This causes a vacuum in the body 10 in relation to the outside, tending to aspirate a residual quantity of liquid present in the portion 29 and outside air through the membrane 28.

The user then screws the cap 16 back (FIG. 2) until it is completely closed, that is, until a bottom 40 of the cap 14 is in sealed contact with the orifice 26*b*, which interrupts the re-aspiration of collyrium and the aspiration of air.

The aspiration of the residual quantity of liquid in the portion 29 prevents the stagnation of this liquid in the portion 29 between two uses. The aspiration of outside air enables the volume of collyrium dispensed to be replaced.

The aspirated liquid preferably passes through the liquophilic regions of the membrane 28 thus being filtered through it, and the aspirated air preferably passes through the liquophobic regions of the membrane 28 thus being filtered through it.

Due to the small porous surface offered by the membrane 28 to the air and the collyrium, the membrane 28 constitutes a brake on the re-aspiration of the residual quantity of collyrium and the aspiration of air. The resilience of the walls of the body 10 is not generally sufficient to ensure the complete re-aspiration of the residual quantity of collyrium located in the portion 29 before the complete closure of the cap 14.

Consequently there is a risk that a quantity of collyrium may be trapped in the portion 29 and that contaminating agents may develop in this quantity of trapped collyrium, which would be dispensed first when next dispensing takes place.

Furthermore, if the body 10 does not aspirate sufficient air before the cap 14 is closed, a depression exists inside the body and it is necessary to apply a greater force on the walls of the body 10, when next dispensing collyrium, in order to deform the body 10 sufficiently for drops of collyrium to come out of the device 6.

The lip 38 and the block 39 limit these risks by increasing the entry of air and the re-aspiration of the quantity of collyrium trapped after dispensing.

Indeed, at the start of closing the cap 14 (FIG. 4), the lip 38 comes into sealed contact at its free end with a cylindrical seating internal bearing surface 41 with an axis L of the cap 14. The lip 38 thus closes in a sealed manner a space 42 located between the spout 20 and the bottom 40 of the partially closed cap 14.

In this position, the end 34 is located at a distance from the bottom 40, in such a way that the orifice 26*b* is still open and the passage 26 communicates with the space 42.

On continuing to close the cap 14, the lip 38 slides along the bearing surface 41 of the cap 14 which moves along the axis L in relation to the lip 38, and the volume of the space 42 gradually diminishes. An overpressure then occurs in the space 42 and in the portion 29 in relation to the pressure existing upstream of the membrane 28.

This overpressure gradually increases and pushes the quantity of collyrium trapped in the portion 29 and air through the membrane 28. This thus encourages the re-aspiration of collyrium and the aspiration of air into the container 4 before the complete closure of the cap 14.

It will be noted that the lip 38 is inclined in relation to the axis L and extends axially towards the bottom 40. This results in an effective seal due to the fact that the overpressure in the space 42 tends to flatten the lip 38 against the bearing surface 41.

Furthermore, the block 39 prevents the formation of a film of collyrium, held by capillary action on the upstream face 28*a* of the membrane 28. Such a film would prevent the aspiration of air and also the re-aspiration of some of the trapped collyrium by obstructing the pores of the membrane 28.

The block 39, due to the fact that it is porous and liquophobic, causes the grouping or coalescence of the collyrium held on the membrane 28 into drops which are formed in the porosities of the block 39. The block 39 thus encourages the re-aspiration of collyrium from the upstream side of the membrane 28, as well as the entry of air into the body 10 by freeing channels for the circulation of air between the drops of collyrium, inside the block 39.

The block 39 is made, for example, of a polyurethane open-cell foam (PUR), PTFE, PVC, polyester, polyether, polyethylene or polypropylene. The block 39 has, for example, a porosity of 10 to 100 PPI (pores per inch).

The assembly 2 thus encourages the re-aspiration of collyrium and the aspiration of air into the container 4 before it is closed. The assembly 2 thus allows the quantity of collyrium trapped downstream of the membrane, and consequently the risk of contamination, to be limited.

The aspiration of the quantity of trapped collyrium and the aspiration of air are particularly effective due to the fact that the force exerted by the user to close the cap 14 is used to force the entry of collyrium and the entry of air through the membrane 28.

The block 39 and the lip 38 can be used independently of each other while retaining their respective advantages, to encourage the aspiration of collyrium and/or air into the container.

The invention thus generally relates to an assembly for containing and dispensing a liquid, comprising a container for containing the liquid, and a liquid dispensing device, comprising a spout through which liquid can pass out and air can come in, and means for filtering liquid and air passing through the spout, and a cap for closing the container, the assembly also comprising sealing means capable of closing in a sealed manner a space located between the spout and the partially closed cap, the volume of which decreases as closure of the cap progresses, so as to create an overpressure in the spout downstream of the filtering means, due to the cap being closed.

The invention also generally relates to an assembly for containing and dispensing a liquid, comprising a container for containing liquid, and a liquid dispensing device, comprising a spout through which liquid can pass out and air can come in, and means for filtering liquid and air passing through the spout, and a cap for closing the container, the assembly also comprising a layer of liquophobic porous material, in contact with an upstream face of the membrane.

The invention applies to assemblies for containing and dispensing collyrium, and more generally to assemblies for containing and dispensing a liquid, the sterility of which must be maintained.

The invention claimed is:

1. An assembly for containing and dispensing a liquid, comprising:

a container for containing the liquid; and a liquid dispensing device comprising:

a spout through which the liquid can pass out and air can come in;

means for filtering the liquid and the air passing through the spout;

a cap for closing the container; and means for encouraging entry of air and/or return of a residual quantity of the liquid trapped in the spout after dispensing some of the liquid, through the means for filtering, into the container, wherein the means for encouraging entry of air and/or return of a residual quantity of the liquid comprise means for sealing capable of closing in a sealed manner a space located between the spout and the partially-closed cap, a volume of which decreases as closure of the cap progresses, so as to create an overpressure in the spout downstream of the filtering means, due to the cap being closed.

2. The assembly according to claim 1, wherein the means for sealing comprise a sealing lip which is integral with the spout and comes into sealed contact with an internal sealing bearing surface of the cap as the cap is closed.

3. The assembly according to claim 2, wherein the lip is integral with a part of a tubular spout having a longitudinal axis (L).

4. The assembly according to claim 3, wherein the lip extends beyond the part, said lip being inclined in relation to the longitudinal axis (L), radially outwards and axially towards a bottom of the cap.

5. The assembly according to claim 1, wherein the cap comprises a bottom coming into sealed contact with an outlet orifice of the spout when the cap is completely closed.

6. The assembly according to claim 1, wherein the means for filtering comprise at least one microporous filtering membrane extending through a passage for circulation of the liquid and the air through the spout.

7. The assembly according to claim 6, wherein the microporous filtering membrane comprises at least one liquophilic region and at least one liquophobic region.

8. The assembly according to claim 6, wherein the membrane is secured between two mutually-fixed parts of the spout.

9. The assembly according to claim 6, wherein the means for encouraging entry of air and/or return of a residual quantity of the liquid comprise a layer of porous liquophobic material, capable of being passed through by the liquid, in contact with an upstream face of the membrane.

10. The assembly according to claim 6, wherein the means for filtering comprise one microporous filtering membrane.

11. The assembly according to claim 2, wherein the cap comprises a bottom coming into sealed contact with an outlet orifice of the spout when the cap is completely closed.

12. The assembly according to claim 2, wherein the means for filtering comprise at least one microporous filtering membrane extending through a passage for circulation of the liquid and the air through the spout.

13. The assembly according to claim 7, wherein the membrane is secured between two mutually-fixed parts of the spout.

14. The assembly according to claim 7, wherein the means for encouraging entry of air and/or return of a residual quantity of the liquid comprise a layer of porous liquophobic material, capable of being passed through by the liquid, in contact with an upstream face of the membrane.

15. The assembly according to claim 8, wherein the means for encouraging entry of air and/or return of a residual quantity of the liquid comprise a layer of porous liquophobic material, capable of being passed through by a liquid, in contact with an upstream face of the membrane.

16. The assembly according to claim 3, wherein the means for filtering comprise at least one microporous filtering membrane extending through a passage for circulation of the liquid and the air through the spout.

17. The assembly according to claim 4, wherein the means for filtering comprise at least one microporous filtering membrane extending through a passage for circulation of the liquid and the air through the spout.

18. The assembly according to claim 5, wherein the means for filtering comprise at least one microporous filtering membrane extending through a passage for circulation of the liquid and the air through the spout.

* * * * *